US006001166A

United States Patent [19]

Ettl et al.

[11] Patent Number: 6,001,166

[45] Date of Patent: Dec. 14, 1999

[54] AQUEOUS ALKYLDIKETENE DISPERSIONS AND THEIR USE AS SIZE FOR PAPER

[75] Inventors: Roland Ettl, Hassloch; Wolfgang Reuther, Heidelberg; Primoz Lorencak, Ludwigshafen; Johann Bonn, Hessheim, all of Germany

[73] Assignee: BASF Aktiengesellschaft, Ludwigshafen, Germany

[21] Appl. No.: 09/068,025

[22] PCT Filed: Oct. 25, 1996

[86] PCT No.: PCT/EP96/04638

§ 371 Date: May 4, 1998

§ 102(e) Date: May 4, 1998

[87] PCT Pub. No.: WO97/17491

PCT Pub. Date: May 15, 1997

[30] Foreign Application Priority Data

Nov. 3, 1995 [DE] Germany ..... 195 40 998

[51] Int. Cl.[6] ..... D21H 17/17; D21H 17/23; D21H 17/29; D21H 17/72; D21H 21/16

[52] U.S. Cl. ..... 106/287.2; 106/213; 106/243; 162/158; 162/175; 524/47; 524/65

[58] Field of Search ..... 106/287.2, 213, 106/243; 162/158, 175; 524/47, 65

[56] References Cited

U.S. PATENT DOCUMENTS

| | | | |
|---|---|---|---|
| 4,861,376 | 8/1989 | Edwards et al. | 106/123.1 |
| 5,154,763 | 10/1992 | Ksoll et al. | 106/287.2 |

FOREIGN PATENT DOCUMENTS

| | | |
|---|---|---|
| 0 369 328 B1 | 11/1989 | European Pat. Off. . |
| 0 353 212 | 1/1990 | European Pat. Off. . |
| 0 437 764 B1 | 7/1993 | European Pat. Off. . |
| WO 96 31650 | 10/1996 | WIPO . |

OTHER PUBLICATIONS

Database Paperchem, The Institute of Paper Science and Technology, Atlanta, GA., US, Goshiki, K., et al.: "Sizing Composition for Papermaking", XP002024597 siehe Zusammenfassung & JAP. Kokai 250,499/89. Oct. 5, 1998 8 P. CL. D21H3/02. Filed: Jap. Appln. 74,592/88 (Mar. 30, 1988).

*Primary Examiner*—Nathan M. Nutter
*Attorney, Agent, or Firm*—Oblon, Spivak, McClelland, Maier & Neustadt, P.C

[57] ABSTRACT

Aqueous alkyldiketene dispersions comprising an alkyldiketene, cationic starch having an amylopectic content of at least 95% by weight and as anionic dispersants (a) from 0.05 to 1.0% by weight of ligninsulfonic acid, condensates of naphthalenesulfonic acid and formaldehyde, sulfonated polystyrene, salts and mixtures of said polymers and (b) from 0.05 to 1.5% by weight of sulfuric monoesters of alcohols having at least 10 carbon atoms, phosphoric monoesters or diesters of alcohols having at least 10 carbon atoms, sulfuric monoesters of alkoxylated alcohols having at least 10 carbon atoms, phosphoric monoesters or diesters of alkoxylated alcohols having at least 10 carbon atoms, $C_{12}$–$C_{30}$-alkylsulfonic acids, salts and mixtures of said compounds can be used as body size in the manufacture of paper, paperboard and cardboard and for making cellulose fibers hydrophobic.

8 Claims, No Drawings

AQUEOUS ALKYLDIKETENE DISPERSIONS AND THEIR USE AS SIZE FOR PAPER

CROSS-REFERENCE TO RELATED APPLICATIONS

The present application is a continuation of a PCT application filed under 35USC371 on Oct. 25, 1996.

BACKGROUND OF THE INVENTION

1. Field of the Invention

The present invention relates to aqueous alkyldiketene dispersions comprising an alkyldiketene, cationic starch and anionic dispersants, and to the use of the aqueous alkyldiketene dispersions as body size in the manufacture of paper, paperboard and cardboard and also for making cellulose fibers hydrophobic.

2. Description of the Background

EP-B-0 353 212 discloses sizes in the form of aqueous emulsions comprising a hydrophobic cellulose-reactive size, e.g. fatty alkyldiketene, and a cationic starch having an amylopectin content of at least 85% and a degree of cationization (D.S.) of from 0.045 to 0.4. The proportion of amylopectin in the cationic starch is preferably from 98 to 100%.

EP-B-0 369 328 discloses aqueous alkyldiketene dispersions containing up to 30% by weight of ketenedimer. Further essential constituents of these alkyldiketene dispersions are cationic starch, preferably cationic waxy maize starch, aluminum sulfate, carboxylic acids having from 1 to 10 carbon atoms, and sulfonates such as the sodium salt of ligninsulfonic acid or condensation products of formaldehyde and naphthalenesulfonic acids.

EP-B-0 437 764 discloses stabilized aqueous alkyldiketene dispersions comprising, apart from an alkyldiketene, a protective colloid and an ester of a long-chain carboxylic acid and a long-chain alcohol. Preferred protective colloids are cationic starches. In addition, sorbitan esters, soaps, synthetic detergents and thickeners such as polymers of acrylamide, vinylpyrrolidone and N-vinyl-2-methylimidazoline can also be used.

SUMMARY OF THE INVENTION

It is an object of the present invention to provide novel aqueous alkyldiketene dispersions which have a long shelf life and, if possible, are shear stable and have a high concentration of dispersed alkyldiketene.

We have found that this object is achieved by means of aqueous alkyldiketene dispersions comprising an alkyldiketene, cationic starch and anionic dispersants, if the cationic starch has an amylopectin content of at least 95% by weight and the anionic dispersants present in the dispersions are (a) from 0.05 to 1.0% by weight of ligninsulfonic acid, condensates of naphthalenesulfonic acid and formaldehyde, sulfonated polystyrene, salts and mixtures of said polymers and (b) from 0.05 to 1.5% by weight of sulfuric monoesters of alcohols having at least 10 carbon atoms, phosphoric monoesters or diesters of alcohols having at least 10 carbon atoms, sulfuric monoesters of alkoxylated alcohols having at least 10 carbon atoms, phosphoric monoesters or diesters of alkoxylated alcohols having at least 10 carbon atoms, $C_{12}$–$C_{30}$-alkylsulfonic acids, salts and mixtures of said compounds.

The present invention also provides for the use of the above-described aqueous alkyldiketene dispersions as body size in the manufacture of paper, paperboard and cardboard and for making cellulose fibers hydrophobic.

DETAILED DESCRIPTION OF THE PREFERRED EMBODIMENTS

The preparation of the aqueous alkyldiketene dispersions preferably starts from $C_{14}$–$C_{22}$-alkyldiketenes or from mixtures of such alkyldiketenes. Alkyldiketenes are known and commercially available. They are prepared, for example, from the corresponding carboxylic acid chlorides by elimination of hydrogen chloride using tertiary amines. Suitable fatty alkyldiketenes are, for example, tetradecyldiketene, palmityldiketene, stearyldiketene and behenyldiketene. Also suitable are diketenes having different alkyl groups, e.g. stearylpalmityldiketene, behenylstearyldiketene, behenyloleyldiketene or palmitylbehenyldiketene. Preference is given to using stearyldiketene, palmityldiketene, behenyldiketene or mixtures of stearyldiketene and palmityldiketene or mixtures of behenyldiketene and stearyldiketene. The diketenes are present in the aqueous emulsions in concentrations of, for example, from 10 to 45% by weight, preferably from 15 to 25% by weight.

The alkyldiketenes are emulsified in water in the presence of cationic starch which, according to the present invention, has an amylopectin content of at least 95% by weight, preferably from 98 to 100% by weight. Such starches can be obtained, for example, by fractionation of customary native starches or by cultivating plants which produce virtually pure amylopectin starch, cf. Günther Tegge, Stärke und Stärkederivate, Hamburg, Bers-Verlag 1984, pages 157 to 160. Cationic starches having an amylopectin content of at least 95% by weight, preferably from 98 to 100% by weight, are commercially available. The amylopectin starches have a branched structure and a high degree of polymerization. The molecular weights (number average) are, for example, from 200 million to 400 million. For waxy maize starch having an amylopectin content of from 99 to 100%, the literature gives number-average molecular weights of about 320 million. According to the present invention, the cationized starches used have an amylopectin content of at least 95%. The degree of cationization of the starch is described by means of the degree of substitution (D.S.). This value gives the number of cationic groups per monosaccharide unit in the cationic starch. The degree of substitution (D.S.) of the cationic starches is, for example, from 0.010 to 0.150, preferably from 0.02 to 0.1. In most cases it is below 0.045, e.g. the particularly preferred cationic starches have a degree of substitution (D.S.) of from 0.020 to 0.040.

The cationization of the starch containing at least 95% by weight of amylopectin is carried out by introducing groups containing tertiary or quaternary nitrogen atoms, e.g. by reacting suitable starches, in particular waxy maize starch, with dialkylaminoalkyl epoxides of the formula (I)

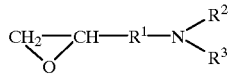

or with dialkylaminoalkyl chlorides of the formula (II)

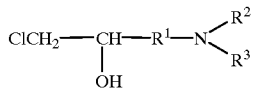

or preferably with epoxide-containing quaternary ammonium salts of the formula (III)

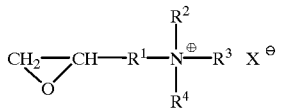

or the corresponding halohydrins of the formula (IV)

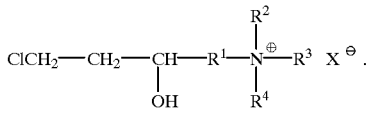

In the formulae I to IV, the substituents $R^2$, $R^3$ and $R^4$ are alkyl, aryl, aralkyl or hydrogen, $R^1$ is an alkylene group, e.g. $C_1$–$C_6$-alkylene. Examples of such compounds are 3-chloro-2-hydroxy-propyltrimethylammonium chloride or glycidyltrimethylammonium chloride.

Apart from the preferred waxy maize starch, other useful starches are waxy potato starch, waxy wheat starch or mixtures of said starches, in each case in cationized form.

The cationic starches having amylopectin contents of at least 95% are present to an extent of from 0.5 to 5% by weight, preferably from 1 to 3% by weight, in the aqueous alkyldiketene dispersion. The finely divided, aqueous alkyldiketene dispersions are usually prepared by first converting the starches containing at least 95% of amylopectin into a water-soluble form. This can be achieved, for example, by means of oxidative or hydrolytic degradation in the presence of acids or by simply heating the cationic starches. The digestion of the starch is preferably carried out in a Jet digester at from 100 to 150° C. In the aqueous solution of the cationic starch having a minimum amylopectin content of at least 95% by weight obtainable in this way, there is then dispersed at least one $C_{14}$–$C_{22}$-alkyldiketene, preferably in the presence of the dispersants (a) and (b) at above 70° C., e.g. in the range from 70 to 85° C. However, if desired, the alkyldiketenes can also be dispersed in the presence of at least one dispersant (a) or (b). To obtain the dispersions of the present invention, the other dispersant is then added and the dispersion is homogenized if necessary. However, the dispersants (a) and (b) can also be added to the dispersion obtained after dispersing the alkyldiketene in the above-described aqueous solution of a cationic starch, with the mixture then usually being further subjected to a high shear rate, e.g. in a homogenizer at pressures of up to 1000 bar. The alkyldiketene dispersion is then cooled so that the alkyldiketenes are present in solid form. This gives finely divided aqueous alkyldiketene dispersions having a mean particle diameter of, for example, from 0.5 to 2.5 $\mu$m, preferably from 0.8 to 1.5 $\mu$m.

Suitable dispersants (a) are ligninsulfonic acid, condensates of formaldehyde and naphthalenesulfonic acids, polymers containing styrenesulfonic acid groups, for example sulfonated polystyrenes, or the alkali metal and/or ammonium salts of said compounds containing sulfonic acid groups. They are present in the aqueous alkyldiketene dispersion in amounts of from 0.05 to 1.0% by weight, preferably from 0.01 to 0.5% by weight. The aqueous alkyldiketene dispersions contain as dispersant (b) from 0.05 to 1.5% by weight of sulfuric monoesters of alcohols having at least 10 carbon atoms, phosphoric monoesters or diesters of alcohols having at least 10 carbon atoms, sulfuric monoesters of alkoxylated alcohols having at least 10 carbon atoms, phosphoric monoesters or diesters of alkoxylated alcohols having at least 10 carbon atoms, $C_{12}$–$C_{30}$-alkylsulfonic acids, salts and mixtures of said compounds. The sulfuric monoesters are preferably derived from alcohols having from 12 to 30 carbon atoms or from mixtures of such alcohols. Suitable alcohols for the preparation of sulfuric esters are, for example, lauryl alcohol, palmityl alcohol, stearyl alcohol, behenyl alcohol and the long-chain alcohols obtainable by the oxo process.

The abovementioned alcohols having at least 10 carbon atoms are also suitable for preparing phosphoric monoesters or diesters which are likewise dispersants. The alcohols preferably used for preparing the phosphoric monoesters and diesters usually have from 12 to 30 carbon atoms.

The alcohols having at least 10 carbon atoms, preferably those having from 12 to 30 carbon atoms, can also be reacted in alkoxylated form with sulfuric acid or phosphoric acid to give sulfuric monoesters or phosphoric monoesters or diesters. The alcohols containing at least 10 carbon atoms can, for example, be alkoxylated with ethylene oxide, propylene oxide and/or butylene oxide. Preference is given to using ethoxylated alcohols for preparing the dispersants (b). From 1 to 25 mol, preferably from 1 to 10 mol, of at least one alkylene oxide, preferably ethylene oxide, are used per mol of alcohol. The appropriate alcohols can also be reacted with a plurality of alkylene oxides to form block copolymers containing, for example, blocks of ethylene oxide and propylene oxide or blocks of ethylene oxide, propylene oxide and butylene oxide or blocks of ethylene oxide and butylene oxide. The order of the blocks can here be any desired. Likewise, it is possible to prepare alkoxylated alcohols which have the alkylene oxide units randomly distributed, for example by reacting a mixed gas of ethylene oxide and propylene oxide with the long-chain alcohols. Preference is given to using alcohols having from 12 to 30 carbon atoms which have been reacted with from 2 to 8 mol of ethylene oxide per mol of alcohol.

Further suitable dispersants (b) are $C_{12}$–$C_{30}$-alkylsulfonic acids. Preference is given to $C_{18}$–$C_{22}$-alkylsulfonic acids. Apart from the abovementioned compounds containing free acid groups, it is also possible to use as dispersants (a) and (b) the salts of the acid compounds described above under (a) and (b), for example alkali metal, alkaline earth metal and ammonium salts. The dispersants (a) and (b) are particularly preferably in the form of sodium salts. The potassium, lithium, magnesium, calcium and barium salts are also suitable. Preferred aqueous alkyldiketene dispersions comprise, for example, cationic starch having an amylopectin content of at least 98% by weight and a degree of substitution (D.S.) of from 0.02 to 0.1 and, as anionic dispersants, (a) from 0.1 to 0.5% by weight of ligninsulfonic acid, condensates of naphthalenesulfonic acid and formaldehyde, sulfonated polystyrene, salts and mixtures of said polymers and (b) from 0.1 to 1.0% by weight of sulfuric monoesters of alcohols having at least 12 carbon atoms, phosphoric monoesters or diesters of alcohols having at least 12 carbon atoms, sulfuric monoesters of alkoxylated alcohols having at least 12 carbon atoms, phosphoric monoesters or diesters of alkoxylated alcohols having at least 12 carbon atoms, $C_{12}$–$C_{30}$-alkylsulfonic acids, salts and mixtures of said compounds.

Particular preference is given to aqueous alkyldiketene dispersions which comprise (a) from 0.1 to 0.5% by weight of the sodium and/or potassium salts of ligninsulfonic acid or of condensates of naphthalenesulfonic acid and formaldehyde and (b) from 0.1 to 1.0% by weight of the sodium and/or potassium salts of sulfuric monoesters of alcohols having from 16 to 22 carbon atoms and/or sodium and/or potassium salts of $C_{16}$–$C_{22}$-alkylsulfonic acids.

In the preparation of the alkyldiketene emulsions, it is possible to make concomitant use of not only the cationic waxy starches but also, if desired, other customary protective colloids which have previously been used in the preparation of alkyldiketene emulsions, e.g. water-soluble cellulose ethers, polyacrylamides, polyvinyl alcohols, polyvinylpyrrolidones, polyamides, polyamidoamines and mixtures of said compounds. The dispersions of the present invention can, if desired, contain further materials which are customary in alkyldiketene dispersions, e.g.

$C_1$–$C_{10}$-carboxylic acids such as formic acid, acetic acid or propionic acid. The acids are, if present in the alkyldiketene dispersions, used in amounts of from 0.01 to 1% by weight. The alkyldiketene dispersions can, if desired, additionally contain customary biocides which can be employed in amounts of up to 1% by weight.

The aqueous alkyldiketene dispersions of the present invention are storage stable and compared with the highly concentrated aqueous alkyldiketene dispersions known hitherto also shear stable. They can be processed as well as low-concentration aqueous alkyldiketene dispersions.

In the examples, the percentages are by weight and, if not otherwise indicated, parts are by weight.

EXAMPLE 1

A 2.5% strength aqueous solution of a cationic starch having an amylopectin content of 98% and a D.S. of 0.03 is first prepared by suspending the required amount of starch in water, heating this suspension to 95° C. and stirring it at this temperature until a clear solution has been formed.

After cooling to 85° C., 84 parts of the above-described 2.5% strength aqueous solution of starch are admixed with 15.8 parts of a melt of stearyldiketene heated to 85° C., 0.1 part of the sulfuric monoester of an addition product of 3.5 mol of ethylene oxide and 1 mol of hexadecanol and 0.1 part of ligninsulfonate. The mixture is subsequently treated for 1 minute with an Ultraturrax and then homogenized twice in a homogenizer (LAB 100) at a pressure of 200 bar. After cooling to room temperature, a stearyldiketene dispersion having a solids content of 18.1% is obtained.

EXAMPLE 2

A 3.25% strength aqueous solution of a cationic starch having an amylopectin content of 98% and a D.S. of 0.035 is first prepared by suspending the required amount of starch in water, heating this suspension to 95° C. and stirring it at this temperature until a clear solution has been formed.

77 Parts of the 3.25% strength aqueous starch solution thus prepared are admixed at 85° C. with 20 parts of a melt of stearyldiketene heated to 85° C., 0.3 part of sodium ligninsulfonate and 0.2 part of the phosphoric monoester of hexadecanol. The mixture is subsequently treated for 1 minute with an Ultraturrax and then homogenized twice in a homogenizer (LAB 100) at a pressure of 200 bar. After cooling to room temperature, a stearyldiketene dispersion having a solids content of 23% is obtained.

EXAMPLE 3

A 3.90% strength aqueous solution of a cationic starch having an amylopectin content of 98% and a D.S. of 0.03 is first prepared by suspending the required amount of starch in water, heating this suspension to 95° C. and stirring it at this temperature until a clear solution has been formed.

76 Parts of the 3.90% strength aqueous starch solution thus prepared are admixed at 85° C. with 20 parts of a melt of stearyldiketene heated to 85° C., 0.1 part of a commercial naphthalenesulfonic acid-formaldehyde condensate and 0.5 part of the sodium salt of hexadecylsulfonic acid. The mixture is treated for 1 minute with an Ultraturrax and then homogenized twice in a laboratory homogenizer at a pressure of 200 bar. After cooling to room temperature, a stearyldiketene dispersion having a solids content of 23.6% is obtained.

EXAMPLE 4

Example 3 is repeated with the exception that the aqueous starch solution is prepared in a Jet digester at 135° C. After homogenization and cooling to room temperature, a diketene dispersion having a solids content of 23.6% is obtained.

EXAMPLE 5

A 4.20% strength aqueous solution of a cationic starch having an amylopectin content of 98% and a D.S. of 0.041 is first prepared by suspending the required amount of starch in water and converting the suspension into a solution in a Jet digester at 135° C.

After cooling to 85° C., 71 parts of the 4.20% strength aqueous starch solution thus obtained are admixed with 25 parts of a melt of stearyldiketene heated to 85° C., 0.3 part of a commercial naphthalenesulfonic acid-formaldehyde condensate and 0.5 part of the sodium salt of hexadecylsulfonic acid. The mixture is treated for 1 minute with an Ultraturrax and then homogenized twice in a laboratory homogenizer at a pressure of 200 bar. After cooling to room temperature, a stearyldiketene dispersion having a solids content of 28.8% is obtained.

EXAMPLE 6

Example 5 is repeated with the exception that 0.2 part of sodium ligninsulfonate and 0.7 part of the sulfuric monoester of octadecanol are used as dispersant in place of the amounts of anionic dispersants indicated in Example 5. A stearyldiketene dispersion having a solids content of 28.9% is obtained.

EXAMPLE 7

A 3.90% strength aqueous solution of a cationic starch having an amylopectin content of 98% and a D.S. of 0.035 is first prepared by suspending the required amount of starch in water and converting the suspension into a solution by treatment in a Jet digester at 125° C.

After cooling to 85° C., 76 parts of the 3.9% strength aqueous starch solution thus obtained is admixed with 20 parts of a melt of stearyldiketene heated to 85° C., 0.3 part of a commercial naphthalenesulfonic acid-formaldehyde condensate and 0.2 part of the sulfuric monoester of an addition product of 5 mol of ethylene oxide and 1 mol of octadecanol. The mixture is then treated for 1 minute with an Ultraturrax and subsequently sheared twice in a laboratory homogenizer at a pressure of 200 bar. After cooling to room temperature, a stearyldiketene dispersion having a solids content of 23.5% is obtained.

EXAMPLE 8

A 5.30% strength aqueous solution of a cationic starch having an amylopectin content of 98% and a D.S. of 0.035 is first prepared by suspending the required amount of starch in water and converting the suspension into a solution by treatment in a Jet digester at 135° C.

After cooling to 85° C., 66 parts of the 5.30% strength starch solution are admixed with 30 parts of a melt of stearyldiketene heated to 85° C., 0.3 part of a commercial naphthalenesulfonic acid-formaldehyde condensate and 0.4 part of the monoester of phosphoric acid and an addition product of 6 mol of ethylene oxide and 1 mol of octadecanol. The mixture is treated for 1 minute with an Ultraturrax and subsequently sheared twice in a laboratory homogenizer at a pressure of 200 bar. After cooling to room temperature, a stearyldiketene dispersion having a solids content of 34.2% is obtained.

Comparative Example 1

A 3.25% strength aqueous dispersion of a cationic starch having an amylopectin:amylose ratio of 3:1 and a D.S. of 0.033 is first prepared by suspending the required amount of starch in water and converting the suspension into a solution by stirring at 95° C.

After cooling to 85° C., 77 parts of a 3.25% strength aqueous starch solution thus obtained are admixed with 20 parts of a melt of stearyldiketene heated to 85° C. and 0.3 part of sodium ligninsulfonate. The mixture is treated for 1 minute with an Ultraturrax and then sheared twice in a laboratory homogenizer at a pressure of 250 bar. After cooling to room temperature, a stearyldiketene dispersion having a solids content of 22.8% is obtained.

Comparative Example 2

A 4.20% strength aqueous solution of a cationic starch having an amylopectin:amylose ratio of 3:1 and a D.S. of 0.040 is first prepared. For this purpose, the required amount of starch is suspended in water and brought into solution by heating to 95° C.

After cooling to 85° C., 71 parts of a 4.20% strength aqueous starch solution thus obtained are admixed with 25 parts of a melt of stearyldiketene heated to 85° C. and 0.3 part of a commercial naphthalenesulfonic acid-formaldehyde condensate. The mixture is treated for 1 minute with an Ultraturrax and subsequently sheared twice in a laboratory homogenizer at a pressure of 250 bar. After cooling to room temperature, a stearyldiketene dispersion having a solids content of 28.3% is obtained.

Comparative Example 3

Prior art as described in EP-B-0 437 764

A 2% strength aqueous suspension of a commercial cationic starch (D.S. of 0.02) is prepared by suspending the required amount of cationic starch in water and is then admixed with sufficient sulfuric acid to bring the pH to 3. The starch suspension is then heated to 95° C. and stirred for 1 hour at this temperature. An aqueous starch solution is obtained.

78 Parts of the 2% strength aqueous starch solution thus prepared are admixed at 85° C. with a melt comprising 20 parts of stearyldiketene and 2 parts of oleyl stearate heated to 90° C. and the mixture is treated for 3 minutes with an Ultraturrax. The emulsion is subsequently homogenized twice at 70° C. in a laboratory homogenizer under a pressure of 150 bar and is then cooled to room temperature. A stable stearyldiketene dispersion having a solids content of 23.5% is obtained.

Comparative Example 4

Prior art as described in EP-B-0 353 212

Suspending 125 parts of a cationic starch having an amylopectin content of 99% and a D.S. of 0.072 in 2500 parts of water and subsequent heating gave a clear, highly viscous, 4.76% strength aqueous starch solution. This mixture was admixed with 20 parts of the sodium salt of sulfonated polystyrene in 500 parts of stearyldiketene while stirring. The coarse dispersion thus obtained was sheared in a homogenizer at 200 bar, cooled and subsequently diluted to a solids content of 12.9% by addition of water.

Comparative Example 5

Prior art as described in EP-B-0 369 328

A 5.05% strength aqueous solution of cationic starch (Amaizo 2187) is first prepared by suspending 67.5 g of the commercial starch having a moisture content of 13% and 6 g of sodium ligninsulfonate in 1090.2 g of water and heating the suspension. 15 g of a 5% strength aqueous acetic acid solution and 300 g of stearyldiketene are subsequently added. The coarse suspension thus obtained is cooled to 70° C. and homogenized in a laboratory homogenizer under a pressure of 200 bar. The emulsion is, while still hot, admixed while stirring with 19.6 g of a 5% strength aluminum sulfate solution and the mixture is cooled to 25° C. The stearyldiketene dispersion has a solids content of 24.5%.

The table shows the viscosities of the aqueous alkyldiketene dispersions directly after preparation and after storage for 90 days at 25° C. The table also gives sizing values obtained using the alkyldiketene dispersions from the examples and comparative examples with the following composition model: wood-free, 100% bleached birch sulfate having a degree of milling of 35° Schopper-Riegler, 40% of chalk and 0.025% of a commercial high molecular weight polyacrylamide as retention agent. Paper sheets having a weight per unit area of 80 g/m$^2$ were produced on a Rapid-Köthen sheet maker. The ash content was 17%. The sizing values were determined after storage for 48 hours at 23° C.

To obtain comparable results, 0.1% of the alkyldiketene dispersions prepared in the examples or comparative examples, based on solid alkyldiketene, was in all cases added to the composition model.

TABLE

| | Viscosity [mpas] | | | Ink |
|---|---|---|---|---|
| | directly after preparation of the dispersion | after storage of the dispersion for 90 days | Cobb | floatation time [min] |
| Example | | | | |
| 1 | 14.1 | 87.6 | 24 | 60 |
| 2 | 19.7 | 78.3 | 23 | 55 |
| 3 | 23.2 | 152.5 | 26 | 56 |
| 4 | 18.6 | 84.0 | 25 | 60 |

TABLE-continued

| | Viscosity [mpas] | | | Ink |
|---|---|---|---|---|
| | directly after preparation of the dispersion | after storage of the dispersion for 90 days | Cobb | floatation time [min] |
| 5 | 34.7 | 248.7 | 24 | 60 |
| 6 | 31.6 | 212.4 | 26 | 53 |
| 7 | 25.9 | 189.9 | 28 | 60 |
| 8 | 54.8 | 545 | 28 | 52 |
| Comparative example | | | | |
| 1 | 89.8 | >2000 | 25 | 60 |
| 2 | 237.1 | –[1)] | 26 | 48 |
| 3 | 265.2 | –[1)] | 26 | 53 |
| 4 | 14.0 | 65.6 | 25 | 55 |
| 5 | 33.2 | 217.5 | 27 | 55 |

[1)]Viscosity could not be determined because the mixture was solid

We claim:

1. An aqueous alkyldiketene dispersion comprising an alkyldiketene, cationic starch and anionic dispersants, wherein the cationic starch has an amylopectin content of at least 95% by weight and the anionic dispersants present in the dispersion are (a) from 0.05 to 1.0% by weight of ligninsulfonic acid, condensates of naphthalenesulfonic acid and formaldehyde, sulfonated polystyrene, salts and mixtures of said polymers and (b) from 0.05 to 1.5% by weight of sulfuric monoesters of alcohols having at least 10 carbon atoms, phosphoric monoesters or diesters of alcohols having at least 10 carbon atoms, sulfuric monoesters of alkoxylated alcohols having at least 10 carbon atoms, phosphoric monoesters or diesters of alkoxylated alcohols having at least 10 carbon atoms, $C_{12}$–$C_{30}$-alkylsulfonic acids, salts and mixtures of said compounds.

2. An aqueous alkyldiketene dispersion as claimed in claim 1, wherein the cationic starch has an amylopectin content of at least 98% by weight and a degree of substitution (D.S.) of from 0.02 to 0.1 and the anionic dispersants present are (a) from 0.1 to 0.5% by weight of ligninsulfonic acid, condensates of naphthalenesulfonic acid and formaldehyde, sulfonated polystyrene, salts and mixtures of said polymers and (b) from 0.1 to 1.0% by weight of sulfuric monoesters of alcohols having at least 12 carbon atoms, phosphoric monoesters or diesters of alcohols having at least 12 carbon atoms, sulfuric monoesters of alkoxylated alcohols having at least 12 carbon atoms, phosphoric monoesters or diesters of alkoxylated alcohols having at least 12 carbon atoms, $C_{12}$–$C_{30}$-alkylsulfonic acids, salts and mixtures of said compounds.

3. An aqueous alkyldiketene dispersion as claimed in claim 1 comprising cationic waxy maize starches.

4. An aqueous alkyldiketene dispersion as claimed in claim 1, wherein the degree of substitution (D.S.) of the cationic starches is below 0.045.

5. An aqueous alkyldiketene dispersion as claimed in claim 1, wherein the degree of substitution (D.S.) of the cationic starches is from 0.02 to 0.040.

6. An aqueous alkyldiketene dispersion as claimed in claim 1, comprising (a) from 0.1 to 0.5% by weight of the sodium and/or potassium salts of ligninsulfonic acid or of condensates of naphthalenesulfonic acid and formaldehyde and (b) from 0.1 to 1.0% by weight of the sodium and/or potassium salts of sulfuric monoesters of alcohols having from 16 to 22 carbon atoms and/or sodium and/or potassium salts of $C_{16}$–$C_{22}$-alkylsulfonic acids.

7. A method of manufacturing paper, paperboard and cardboard, comprising:

applying the aqueous alkyldiketene dispersion of claim 1 to said paper, paperboard or cardboard during its manufacture.

8. A method of making cellulose fibers hydrophobic comprising:

applying the aqueous alkyldiketene dispersion of claim 1 to cellulose fibers thereby hydrophobicizing the cellulose fibers.

* * * * *